US010641061B2

(12) United States Patent
Bowersock et al.

(10) Patent No.: US 10,641,061 B2
(45) Date of Patent: May 5, 2020

(54) HYDRAULIC PORT COLLAR

(71) Applicant: TAM INTERNATIONAL, INC., Houston, TX (US)

(72) Inventors: Justin Bowersock, Spring, TX (US); Luis Garcia, Kingwood, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 0 days.

(21) Appl. No.: 16/332,972

(22) PCT Filed: Sep. 22, 2017

(86) PCT No.: PCT/US2017/053056

§ 371 (c)(1),
(2) Date: Mar. 13, 2019

(87) PCT Pub. No.: WO2018/057958

PCT Pub. Date: Mar. 29, 2018

(65) Prior Publication Data

US 2019/0277109 A1 Sep. 12, 2019

Related U.S. Application Data

(60) Provisional application No. 62/399,062, filed on Sep. 23, 2016.

(51) Int. Cl.
*E21B 34/14* (2006.01)
*E21B 34/10* (2006.01)
(Continued)

(52) U.S. Cl.
CPC ..... *E21B 34/10* (2013.01); *E21B 33/146* (2013.01); *E21B 34/063* (2013.01);
(Continued)

(58) Field of Classification Search
CPC ..... E21B 34/14; E21B 34/063; E21B 34/103; E21B 34/12; E21B 2034/007
See application file for complete search history.

(56) References Cited

U.S. PATENT DOCUMENTS 3,338,311 A 8/1967 Conrad
2007/0261850 A1 11/2007 Giroux et al.
(Continued)

FOREIGN PATENT DOCUMENTS

RU 181716 U1 7/2018
SU 1439211 A1 11/1988
WO 2013115948 A1 8/2013

OTHER PUBLICATIONS

International Search Report issued in PCT/US17/53056, dated Dec. 20, 2017, 2 pages.
(Continued)

*Primary Examiner* — Giovanna C Wright
(74) *Attorney, Agent, or Firm* — Adolph Locklar

(57) ABSTRACT

A hydraulic port collar includes a housing having one or more housing ports. The hydraulic port collar includes a port collar bore disposed within the housing forming an inner surface of the housing. The hydraulic port collar includes a sliding sleeve disposed within the port collar bore. The sliding sleeve has a sliding sleeve inner surface and a sliding sleeve outer surface. The hydraulic port collar includes a dissolvable or fragmentable landing seat radially aligned with and abutting the sliding sleeve inner surface.

7 Claims, 17 Drawing Sheets

(51) Int. Cl.

| | |
|---|---|
| ***E21B 34/06*** | (2006.01) |
| ***E21B 33/14*** | (2006.01) |
| *E21B 34/00* | (2006.01) |
| *E21B 29/02* | (2006.01) |

(52) U.S. Cl.
CPC ..... *E21B 34/102* (2013.01); *E21B 34/103* (2013.01); *E21B 34/14* (2013.01); *E21B 29/02* (2013.01); *E21B 33/14* (2013.01); *E21B 2034/007* (2013.01)

(56) References Cited

U.S. PATENT DOCUMENTS

2012/0181044 A1* 7/2012 Nikiforuk ..... E21B 7/20 166/374
2012/0318513 A1 12/2012 Mazyar et al.
2013/0032357 A1 2/2013 Mazyar et al.
2015/0096767 A1* 4/2015 Atilano ..... E21B 34/14 166/383
2015/0330185 A1* 11/2015 Hughes ..... E21B 33/1216 166/318
2016/0138367 A1 5/2016 Lirette et al.
2016/0160603 A1 6/2016 Sevadjian et al.
2016/0186511 A1 6/2016 Coronado et al.
2017/0067328 A1* 3/2017 Chauffe ..... E21B 34/14
2017/0204700 A1* 7/2017 Hughes ..... E21B 34/14
2019/0010805 A1* 1/2019 Lafleur ..... E21B 49/008

OTHER PUBLICATIONS

Official Action issued in Russian Application No. 2019112101, dated Dec. 11, 2019, 13 pages.
Abramov A. A. et al, Stepwise cementing of casing cstrings, Overview, "Drilling" Series, Moscow, VNIIOENG, pp. 38-46; 1983.

* cited by examiner

HYDRAULIC PORT COLLAR

CROSS-REFERENCE TO RELATED APPLICATIONS

This application is a National Stage Entry of PCT/US17/53056, filed on Sep. 22, 2017; which itself claims priority from U.S. 62/399,062, filed on Sep. 23, 2016. The entireties of both PCT/US17/53056 and U.S. 62/399,062 are incorporated herein by reference.

TECHNICAL FIELD/FIELD OF THE DISCLOSURE

The present disclosure relates generally to tools for use in a wellbore, and specifically to cementing tools constructed for placement in a well casing.

BACKGROUND OF THE DISCLOSURE

During drilling of wells, it may be desirable to cement the casing in the wellbore in separate stages. For instance, problems during cementing such as lost circulation, sustained casing pressure from gas migration, water pressure, high-pressure gas zones and other issues may make two-stage cementing useful. In certain traditional processes, a two-stage cementing tool may be placed in the casing or between joints of casing at one or more locations in the wellbore. Cement may be flowed through the bottom of the casing and up the annulus to the lowest cementing tool. The lowest cementing tool may close off the bottom. The cementing tool may be opened, and cement flowed through the cementing tool up the annulus to the next-most upper stage. This process may be repeated until stages of cementing the well are completed.

Downhole tools used in a wellbore may be ball, dart, or plug actuated. A ball, dart, or plug may be pumped through the wellbore to engage with a landing seat on the downhole tool to activate the tool. Typical landing seats extend into the interior of the bore of the downhole tool and may restrict or reduce flow or ability of other tools to pass therethrough.

SUMMARY

The present disclosure provides for a hydraulic port collar. The hydraulic port collar may include a housing including one or more housing ports. The hydraulic port collar may include a port collar bore disposed within the housing, the port collar bore forming an inner surface of the housing. The hydraulic port collar may include a sliding sleeve disposed within the port collar bore. The sliding sleeve may have a sliding sleeve inner surface and a sliding sleeve outer surface. The hydraulic port collar may include a dissolvable landing seat. The dissolvable landing seat may be radially aligned with and may abut the sliding sleeve inner surface. The dissolvable landing seat may be formed from a material that selectively at least partially dissolves.

The present disclosure also provides for a hydraulic port collar. The hydraulic port collar may include a housing, the housing including one or more housing ports. The hydraulic port collar may include a port collar bore disposed within the housing forming an inner surface of the housing. The hydraulic port collar may include a sliding sleeve disposed within the port collar bore. The sliding sleeve may have a sliding sleeve inner surface and a sliding sleeve outer surface. The hydraulic port collar may include a fragmentable landing seat. The fragmentable landing seat may be radially aligned with and may abut the sliding sleeve inner surface. The fragmentable landing seat may include a fragmentable flange and a seat body. The fragmentable flange may be mechanically coupled to the sliding sleeve. The fragmentable flange and seat body may be selectively decoupleable.

The present disclosure also provides for a method. The method may include providing a hydraulic port collar. The hydraulic port collar may include a housing including one or more housing ports. The hydraulic port collar may include a port collar disposed within the housing, the port collar bore forming an inner surface of the housing. The hydraulic port collar may include a sliding sleeve disposed within the port collar bore. The sliding sleeve may have a sliding sleeve inner surface and a sliding sleeve outer surface. The hydraulic port collar may include a dissolvable landing seat. The dissolvable landing seat may be radially aligned with and may abut the sliding sleeve inner surface. The dissolvable landing seat may be formed from a material that selectively at least partially dissolves. The method may include positioning the hydraulic port collar within a wellbore. The method may include pumping a ball, dart, or plug through the wellbore into engagement with the dissolvable landing seat. The method may include increasing the pressure in the port collar bore. The method may include shifting the sliding sleeve. The method may include dissolving, at least partially, the dissolvable landing seat.

The present disclosure also provides for a method. The method may include providing a hydraulic port collar. The hydraulic port collar may include a housing, the housing including one or more housing ports. The hydraulic port collar may include a port collar bore disposed within the housing forming an inner surface of the housing. The hydraulic port collar may include a sliding sleeve disposed within the port collar bore. The sliding sleeve may have a sliding sleeve inner surface and a sliding sleeve outer surface. The hydraulic port collar may include a fragmentable landing seat. The fragmentable landing seat may be radially aligned with and may abut the sliding sleeve inner surface. The fragmentable landing seat may include a fragmentable flange and a seat body. The fragmentable flange may be mechanically coupled to the sliding sleeve. The fragmentable flange and seat body may be selectively decoupleable. The method may include positioning the hydraulic port collar within a wellbore. The method may include engaging a ball, dart, or plug with the fragmentable landing seat. The method may include increasing the pressure in the port collar bore. The method may include shifting the sliding sleeve. The method may include increasing the pressure in the port collar bore above a preselected threshold. The method may include decoupling the fragmentable flange from the seat body.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
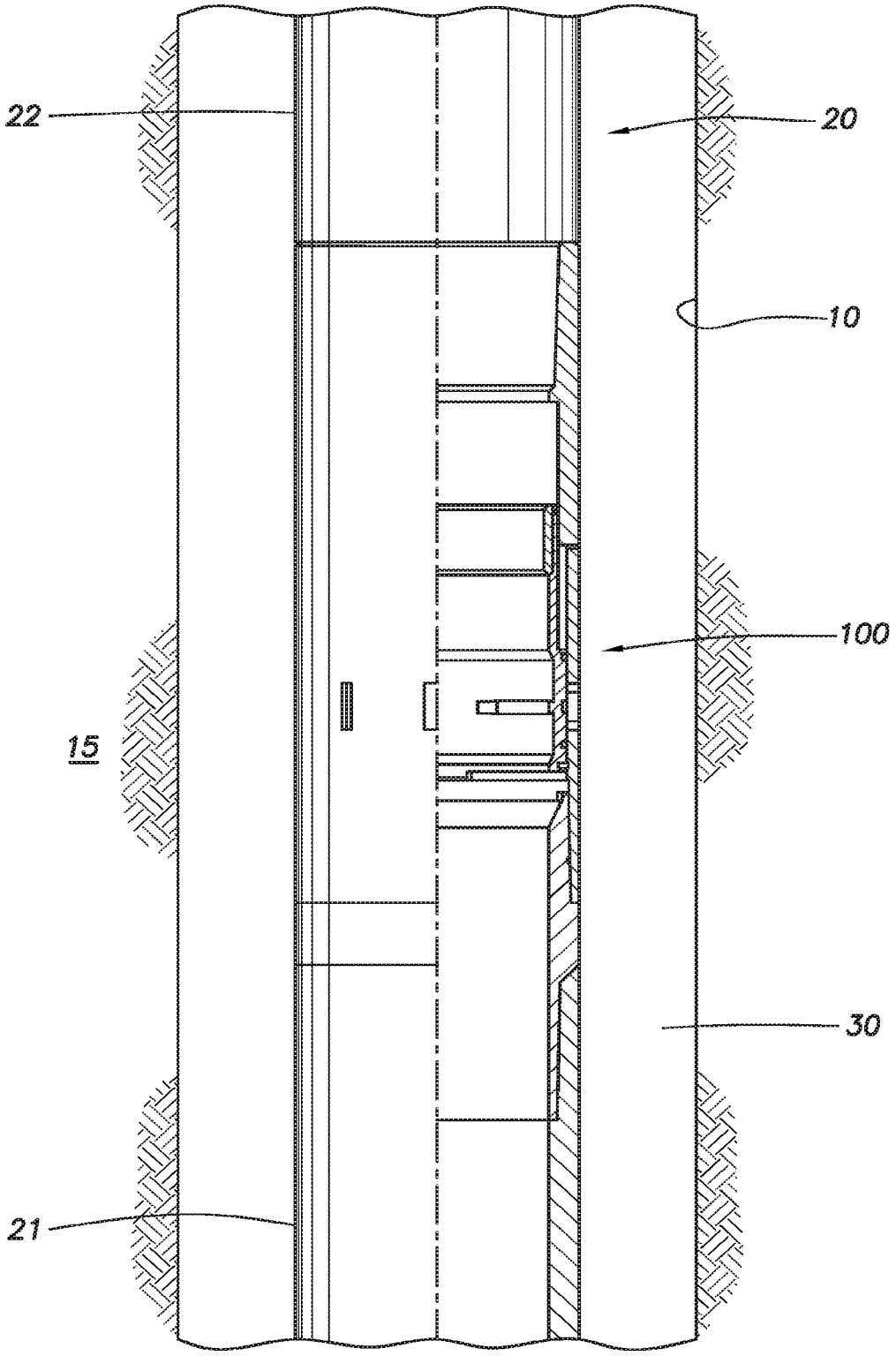
FIG. 1 depicts a hydraulic port collar consistent with at least one embodiment of the present disclosure within a wellbore.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The terms "upper and lower" and "top and bottom" as used herein relate to positions within a wellbore. "Down," "downward" or "downhole" refer to the direction in or along the wellbore from the wellhead.

FIG. 1 depicts hydraulic port collar 100 positioned within wellbore 10. Wellbore 10 is located within formation 15. Hydraulic port collar 100 is mechanically connected to casing 20, which includes upper casing section 22 and lower casing section 21. Casing 20 and wellbore 10 define annulus 30 disposed therebetween.

FIGS. 2-6 depict hydraulic port collar 100 in various configurations. Hydraulic port collar 100 includes upper housing section 110 and lower housing section 120 forming housing 130. As one of ordinary skill in the art will appreciate with the benefit of this disclosure, upper housing section 110 and lower housing section 120 may be formed as a single piece. Housing 130 includes port collar bore 140 disposed therein forming housing inner surface 134. Housing inner surface 134 may include upper shoulder 142 and lower shoulder 144. Housing 130 further includes one or more housing ports 150 formed therein.

Hydraulic port collar 100 further includes sliding sleeve 160 disposed within port collar bore 140. In some embodiments of the present disclosure, hydraulic port collar 100 includes a single sliding sleeve 160. Sliding sleeve 160 is adapted to translate along port collar bore 140 between upper shoulder 142 and lower shoulder 144. In certain embodiments, accumulator 146 may be formed between housing inner surface 134 of lower housing section 120 and sliding sleeve outer surface 164 of sliding sleeve 160. In some embodiments, accumulator 146 may be in fluid communication with annulus 30 through relief port 147. In the run-in position depicted in FIG. 2, sliding sleeve 160 may be positioned such that fluid communication between port collar bore 140 and annulus 30 via housing ports 150 is blocked.

Hydraulic port collar 100 may further include one or more shear pins 170 extending from the inner surface 134 of housing 130. One or more shear pins 170 may interface with shear pin holes 172 located on sliding sleeve outer surface 164. Shear pins 170 may be adapted to "shear" or break when a predetermined pressure is attained within port collar bore 140. Hydraulic port collar may also include locking assembly 174 positioned on sliding sleeve outer surface 164. In certain non-limiting embodiments, locking assembly 174 may be a C-ring. Locking assembly notch 176 may be located along housing inner surface 134. Locking assembly notch 176 may be adapted to receive locking assembly 174, as described herein below.

In certain embodiments of the present disclosure, hydraulic port collar 100 may include dissolvable landing seat 180. Dissolvable landing seat 180 may be radially aligned with and abut sliding sleeve inner surface 166. In some embodiments, dissolvable landing seat 180 may be selectively dissolvable. In some embodiments, dissolvable landing seat 180 may be composed of a material that at least partially dissolves upon a selected condition such as, for example and without limitation, contact with a wellbore fluid at or above a pre-determined temperature or with a wellbore fluid that contains a chemical constituent designed to dissolve dissolvable landing seat 180. In some embodiments, dissolvable landing seat 180 may be formed from, for example and without limitation, magnesium ally, composite, or SAP urethane. In some embodiments, dissolvable landing seat 180 may be adapted to otherwise break down such as, for example and without limitation, by delamination or by undergoing a phase change. Dissolvable landing seat 180 may be adapted to receive closing ball 200, shown in FIG. 4. In certain embodiments of the present disclosure, closing ball 200 may be a plug, dart, or other design adapted to seat against dissolvable landing seat 180.

In some embodiments, closing ball 200 may be formed from a typical material that does not dissolve or otherwise break down. In some embodiments, closing ball 200 may be composed of a material that at least partially dissolves upon contact with a wellbore fluid at or above a pre-determined temperature or that contains a chemical constituent designed to dissolve closing ball 200. In some embodiments, dissolvable closing ball 200 may be formed from, for example and without limitation, magnesium ally, composite, or SAP urethane. In some embodiments, dissolvable landing seat 180 may be adapted to otherwise break down such as, for example and without limitation, by delamination or by undergoing a phase change. In some embodiments, dissolvable landing seat 180 and closing ball 200 may be constructed of the same or different materials.

Figure 2:
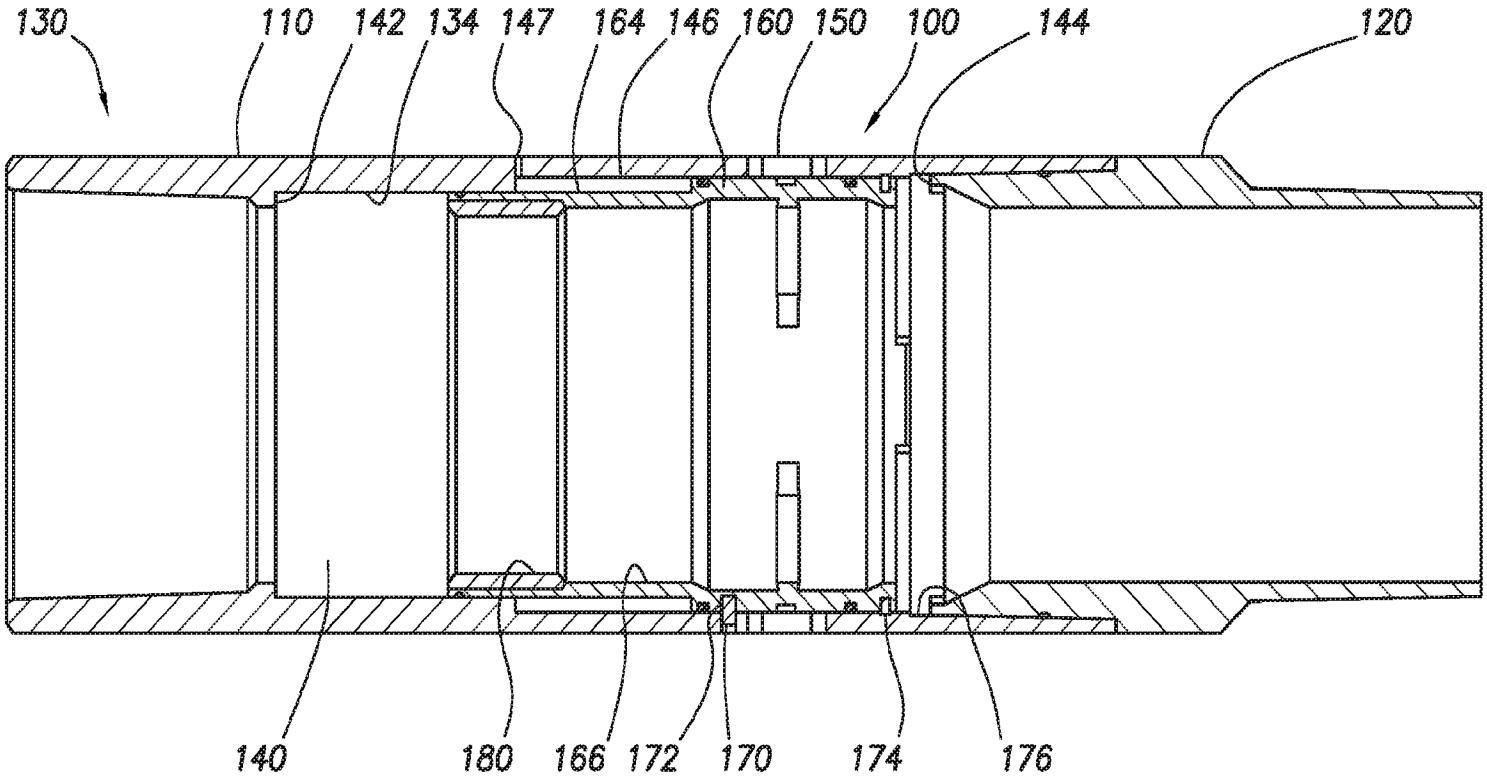
FIG. 2 depicts a hydraulic port collar consistent with at least one embodiment of the present disclosure in a run-in position.

Run in position of hydraulic port collar 100 is shown in FIG. 2. As casing 20 is run into wellbore 10, hydraulic port collar 100 is retained in the run in position. In certain embodiments, one or more fluids such as, for example and without limitation, cement may be pumped through port collar bore 140. In such embodiments, after completion of an initial or "primary" cement job, a cement plug may be pumped or dropped through port collar bore 140 to land on a landing collar (not shown) located below hydraulic port collar 100.

Figure 3:
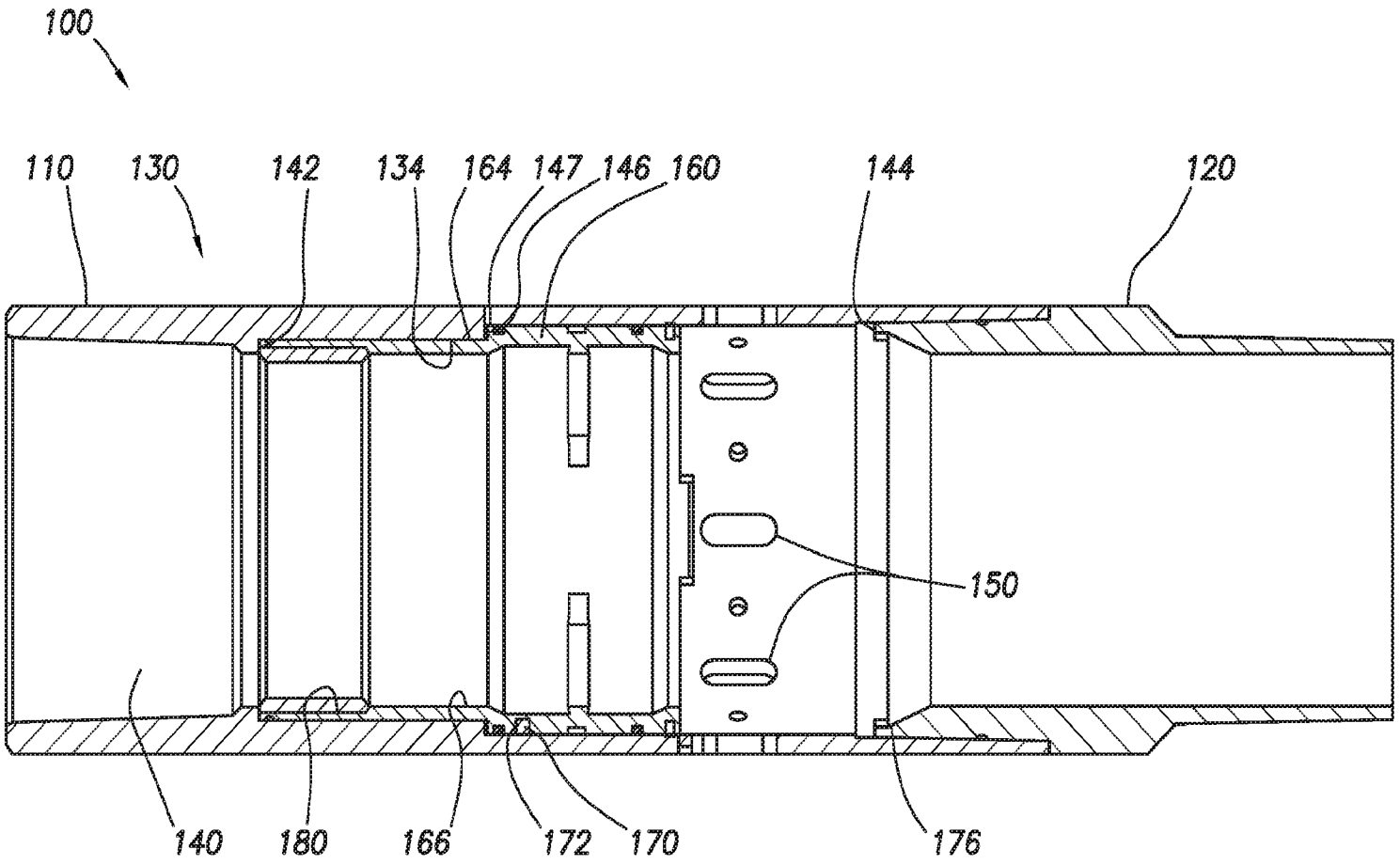
FIG. 3 depicts a hydraulic port collar consistent with at least one embodiment of the present disclosure in an open position.

Following completion of the primary cement job, pressure may be increased within port collar bore 140. The differential pressure between port collar bore 140 and accumulator 146, which is at the pressure of annulus 30, may urge sliding sleeve 160 toward an open position. As shown in FIG. 3, one or more shear pins 170 may be sheared and sliding sleeve 160 traversed upwardly against upper shoulder 142, defining the open position of sliding sleeve 160. When sliding sleeve 160 is in the open position, one or more housing ports 150 may be in fluid communication with port collar bore 140, thereby allowing fluid communication between port collar bore 140 and annulus 30. In certain embodiments, cement may be pumped through one or more housing ports 150 for a "secondary" cement job, or any other fluid may be introduced into annulus 30.

Figure 4:
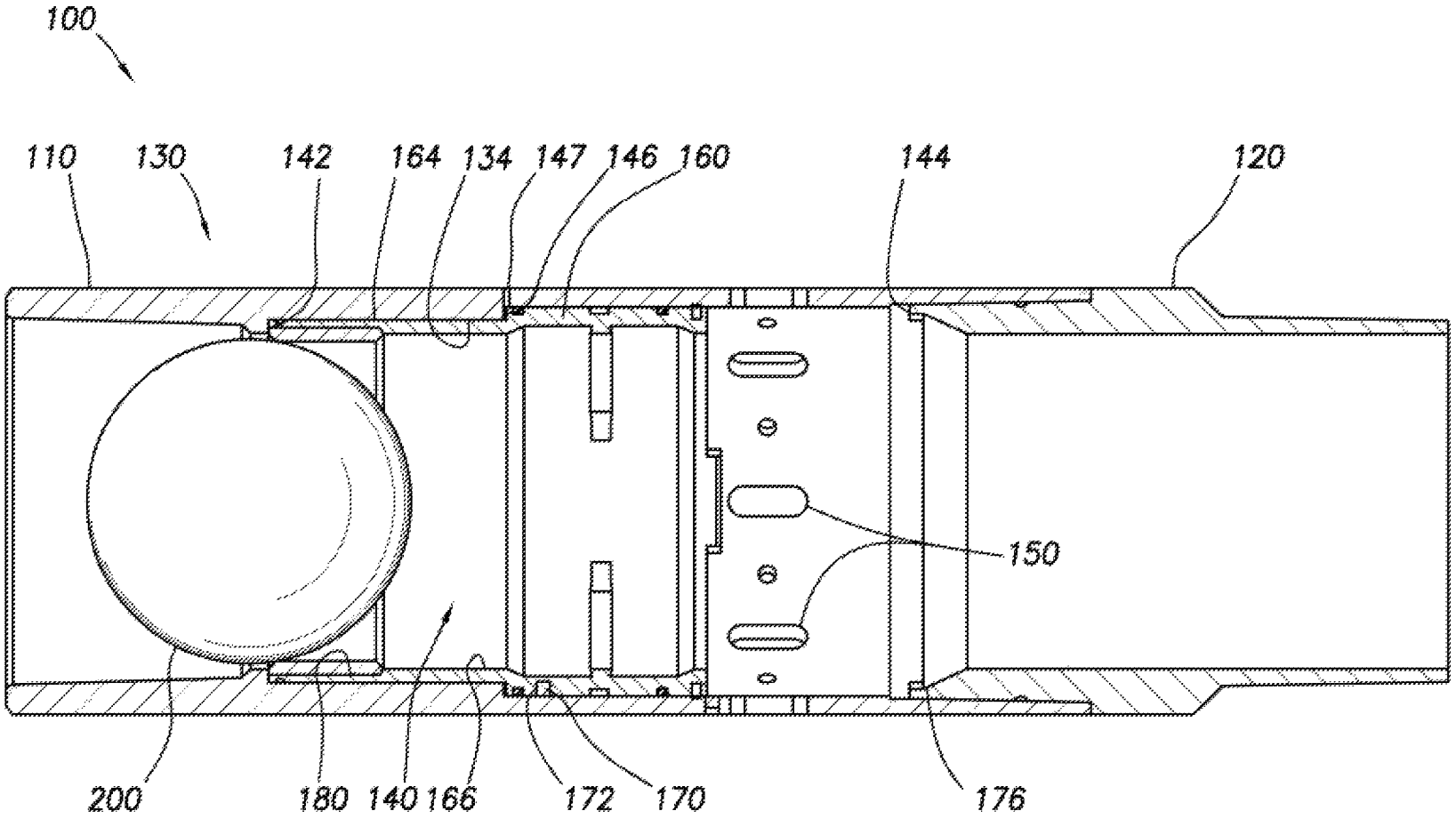
FIG. 4 depicts a hydraulic port collar consistent with at least one embodiment of the present disclosure with a landed closing ball.
Figure 5:
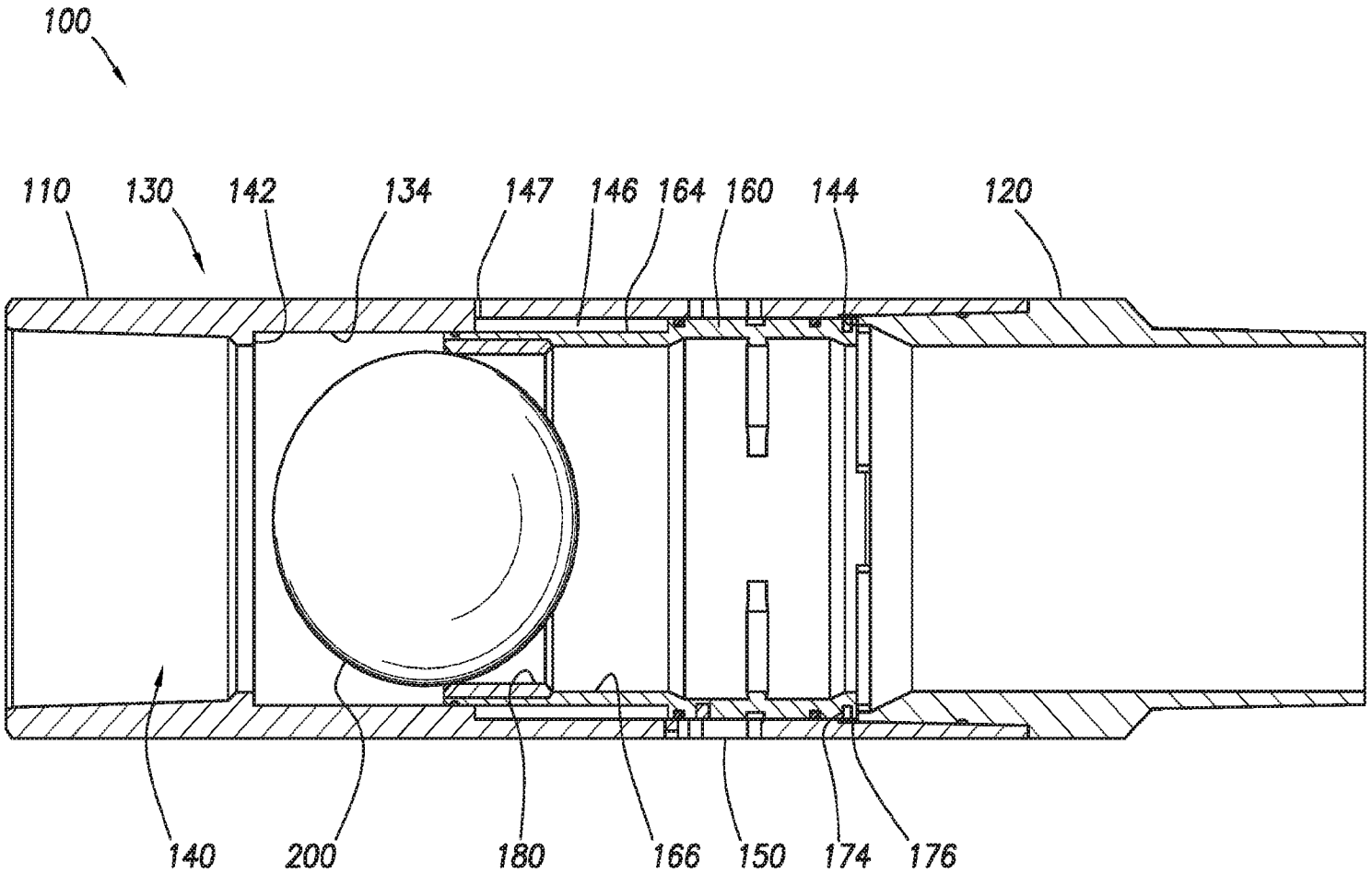
FIG. 5 depicts a port collar consistent with at least one embodiment of the present disclosure with a landed closing ball with applied pressure.

Following completion of the secondary cement job, as shown in FIG. 4, closing ball 200 may be dropped or pumped through port collar bore 140 to seat on dissolvable landing seat 180. As shown in FIG. 5, fluid pressure may be applied to dissolvable landing seat 180 through closing ball 200, thereby traversing sliding sleeve 160 along port collar bore 140 to lower shoulder 144. Locking assembly notch 176 may receive locking assembly 174, retarding further movement of sliding sleeve 160 along port collar bore 140, Housing ports 150 may be aligned with sliding sleeve 160, discontinuing fluid communication between port collar bore 140 and annulus 30.

Figure 6:
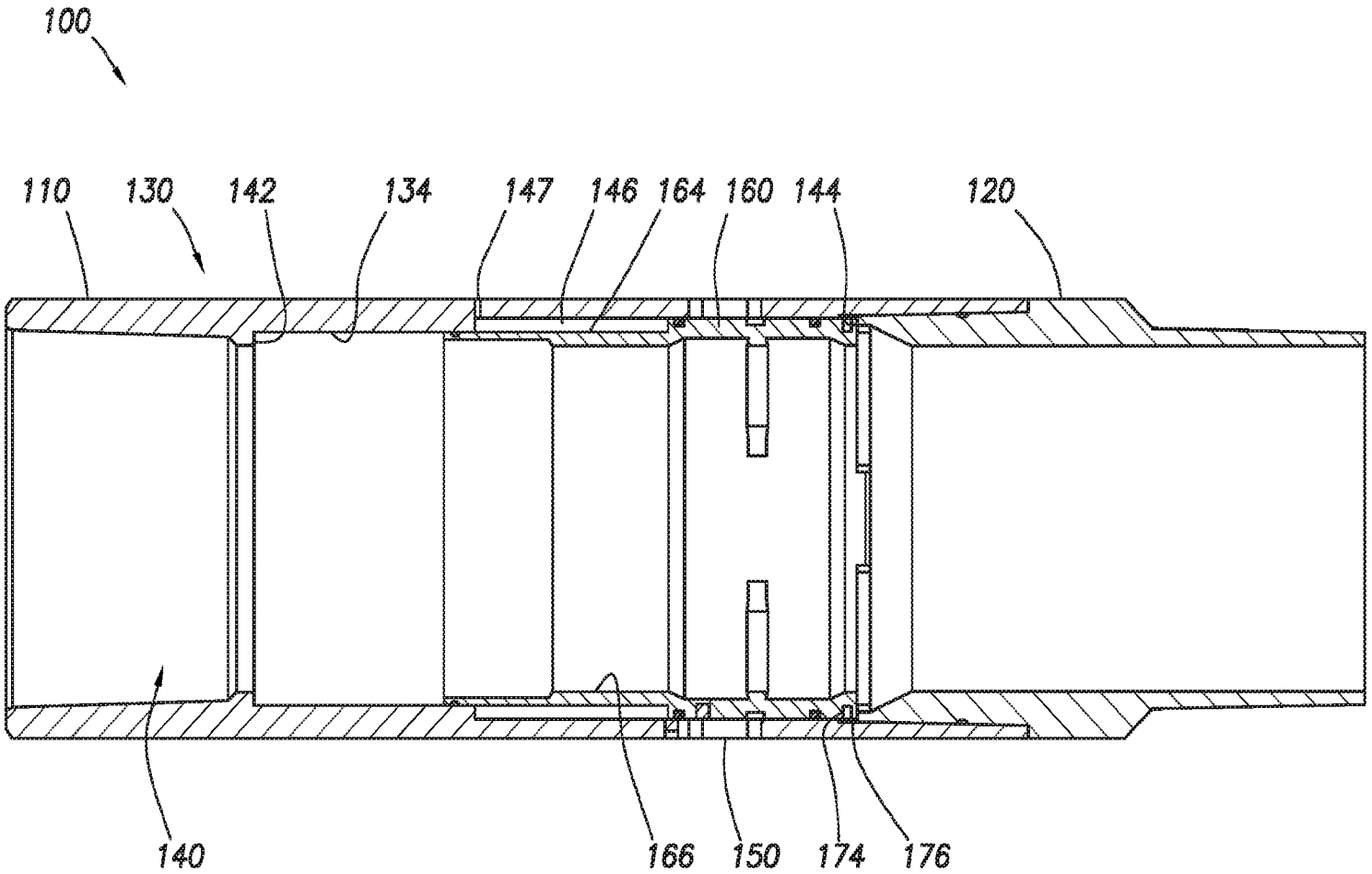
FIG. 6 depicts a port collar consistent with at least one embodiment of the present disclosure in a closed position.

As shown in FIG. 6, dissolvable landing seat 180 and in some embodiments closing ball 200 may at least partially dissolve or break down upon contact with a wellbore fluid at or above a pre-determined temperature or upon contact with a wellbore fluid that contains a chemical constituent designed to dissolve one or more of closing ball 200 and dissolvable landing seat 180. Wellbore fluids may then be pumped through port collar bore 140. Dissolution of one or more of closing ball 200 and dissolvable landing seat 180 may open the full diameter of port collar bore 140 to the passage of one or more of fluids and tools for later operations within casing 20.

Figure 7:
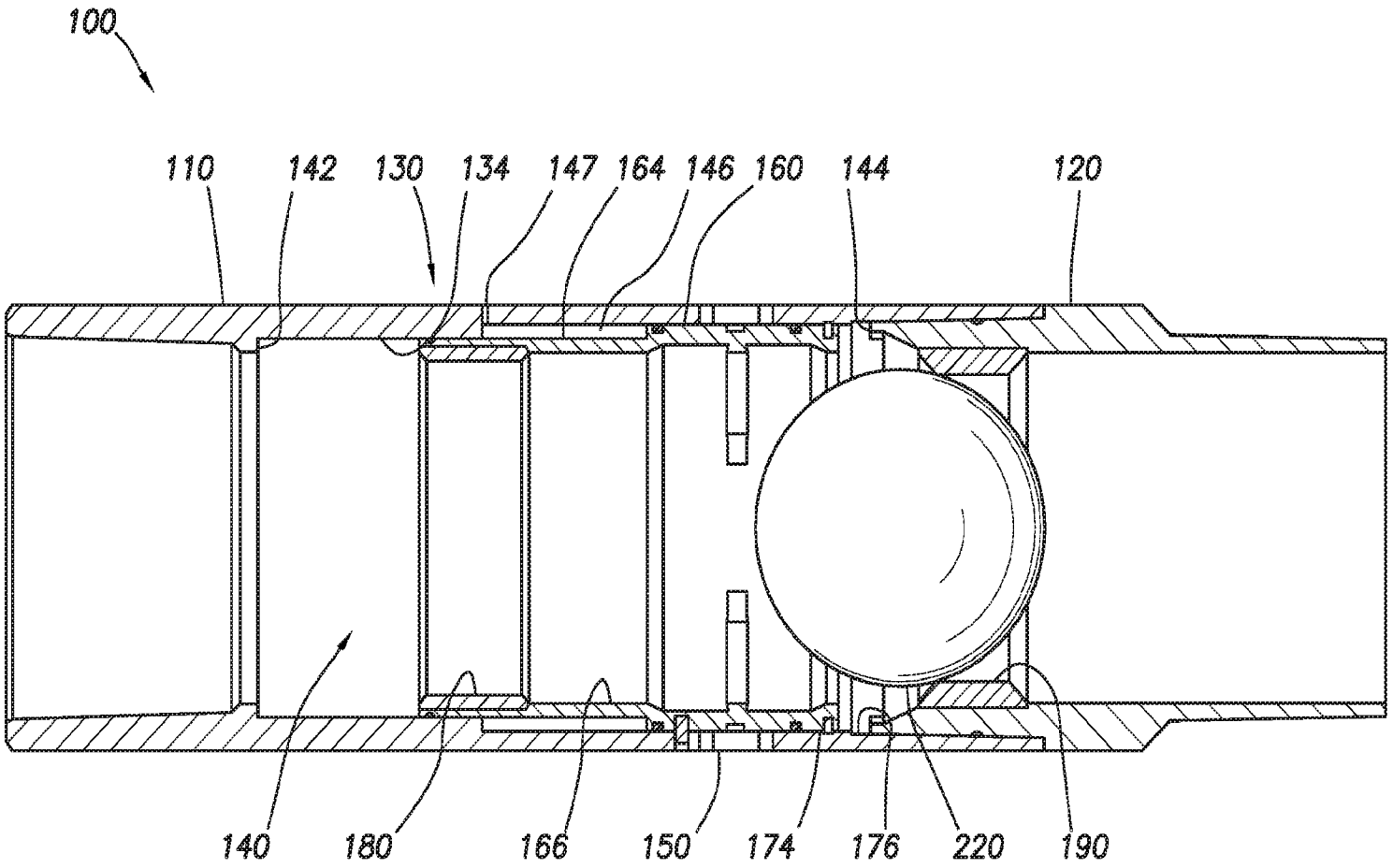
FIG. 7 depicts a port collar consistent with at least one embodiment of the present disclosure with a landed contingency ball in a contingency ball seat.

In certain embodiments of the present disclosure, as depicted in FIG. 7, hydraulic port collar 100 may include dissolvable contingency opening seat 190. Dissolvable contingency opening seat 190 may be adapted to receive contingency ball 220. When seated, contingency ball 220 may, for example and without limitation, block fluid flow to lower casing 21 below dissolvable contingency opening seat 190. For example and without limitation, contingency ball 220 may be dropped or pumped into casing 20 to land on dissolvable contingency opening seat 190 in lieu of a cement plug (not shown), in a case in which the cement plug fails to properly land on the landing collar, or in other situations where not enough pressure is built within port collar bore 140 to shear shear pins 170 or traverse sliding sleeve along port collar bore 140 into the open position. In such a scenario, contingency ball 220, which may be a ball, plug, dart, or any other such device, may be dropped or pumped through port collar bore 140 to seat against dissolvable contingency opening seat 190. Contingency ball 220 may be of a smaller diameter than dissolvable landing seat 180, such that contingency ball 220 may pass through dissolvable landing seat 180. Once contingency ball 220 seats against dissolvable contingency opening seat 190, fluid pressure may be built within port collar bore 140, as described above with respect to FIG. 3.

In some embodiments of the present disclosure, hydraulic port collar 100 may also include dissolvable contingency open seat 190. Dissolvable contingency opening seat 190 may be radially aligned with and abutting housing inner surface 134 of lower housing section 120. Dissolvable contingency opening seat 190 may be composed of a material that dissolves upon contact with a wellbore fluid at or above a pre-determined temperature or that contains a chemical constituent designed to dissolve dissolvable contingency opening seat 190. Dissolvable landing seat 180 may be adapted to receive a dissolvable contingency ball.

Figure 8A:
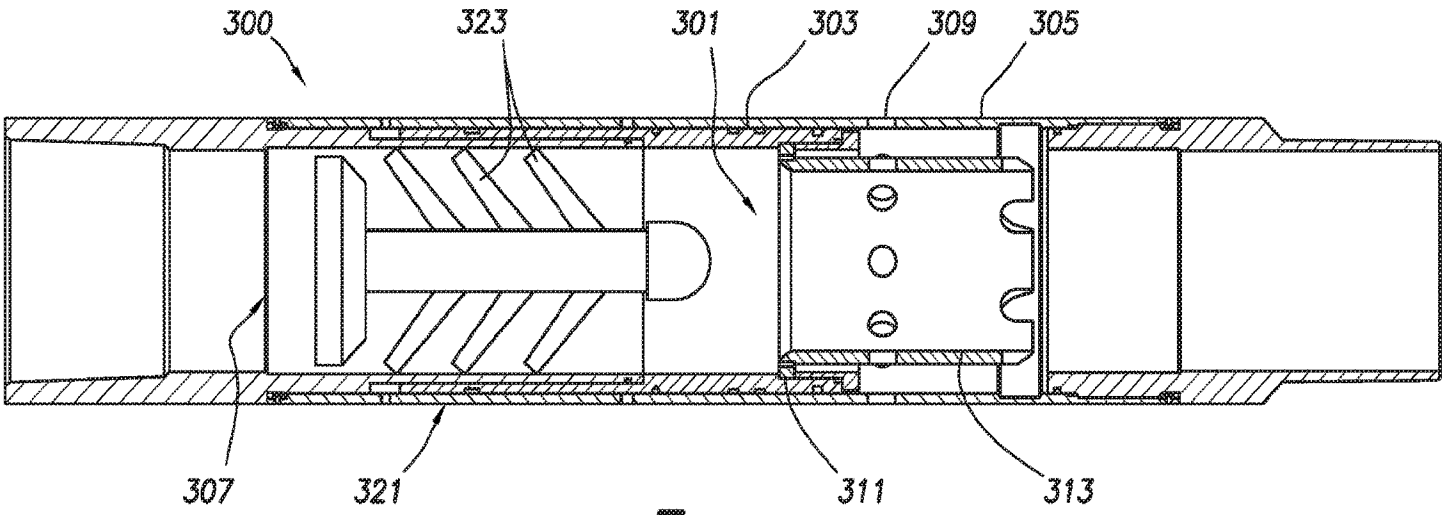
FIGS. 8A-8D depict a port collar having a fragmentable landing seat consistent with at least one embodiment of the present disclosure.
Figure 8B:
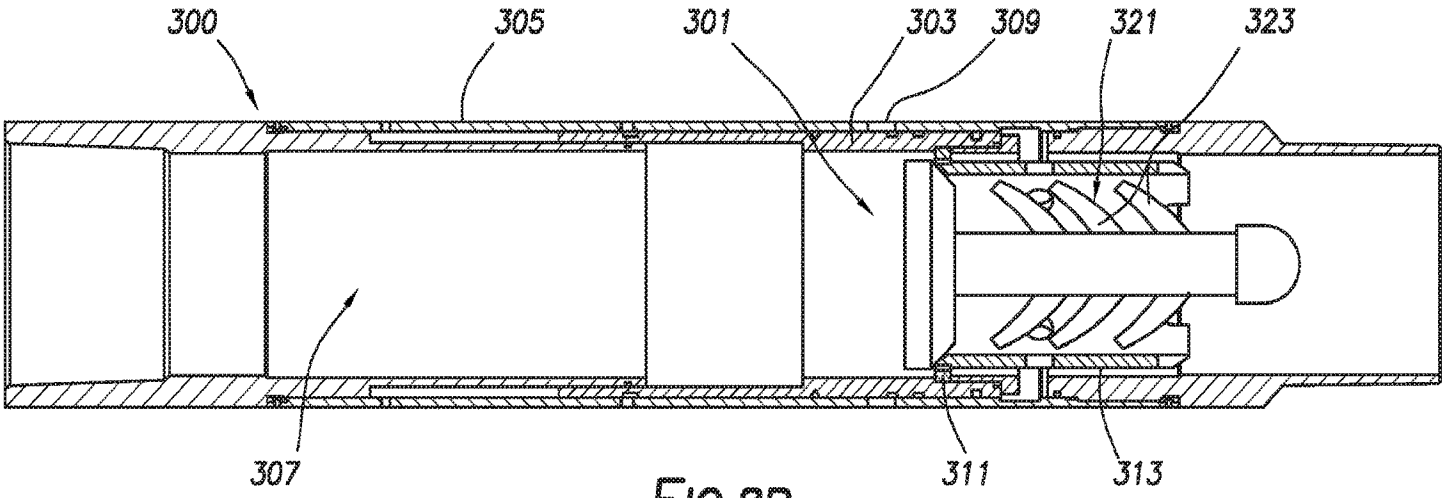

In some embodiments of the present disclosure, as depicted in FIGS. 8A-8D, hydraulic port collar 300 may include fragmentable landing seat 301. Fragmentable landing seat 301 may operate as described herein above with respect to dissolvable landing seat 180. Fragmentable landing seat 301 may be mechanically coupled to sliding sleeve 303 such that as fragmentable landing seat 301 shifts from the open or run in position (depicted in FIG. 8A) to the closed position (depicted in FIG. 8B) due to shifting element 321 landing on fragmentable landing seat 301. Shifting element 321 is depicted in FIGS. 8A, 8B as a dart, but may be a ball, dart, plug, or other device for landing on fragmentable landing seat 301 without deviating from the scope of this disclosure. A pressure increase may cause shifting element 321 to exert a force on fragmentable landing seat 301, as discussed above with respect to dissolvable landing seat 180, causing sliding sleeve 303 to move within housing 305 such that sliding sleeve 303 prevents fluid communication between port collar bore 307 and housing ports 309 as sliding sleeve 303 moves into the closed position.

In some embodiments, fragmentable landing seat 301 may include fragmentable flange 311 and seat body 313. In some embodiments, fragmentable flange 311 may be a generally annular extension from seat body 313. In some embodiments, fragmentable flange 311 may be selectively decoupleable from seat body 313 as discussed further herein below. In some embodiments, fragmentable landing seat 301 may mechanically couple to sliding sleeve 303 by fragmentable flange 311.

Figure 8C:
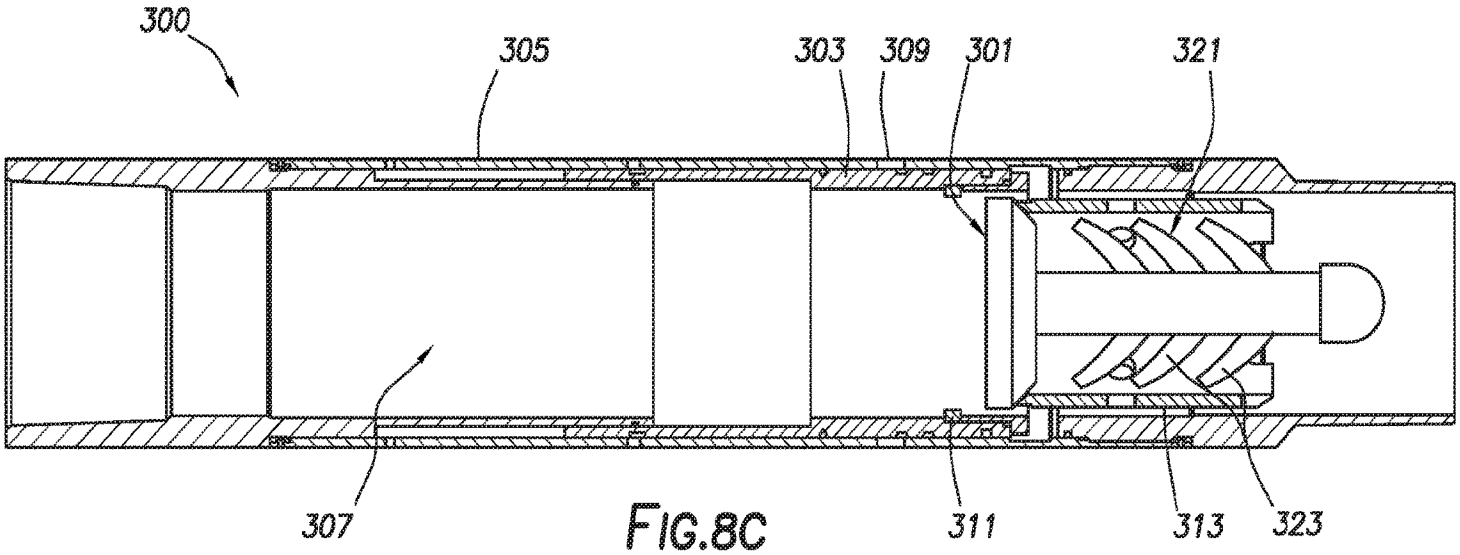
Figure 8D:
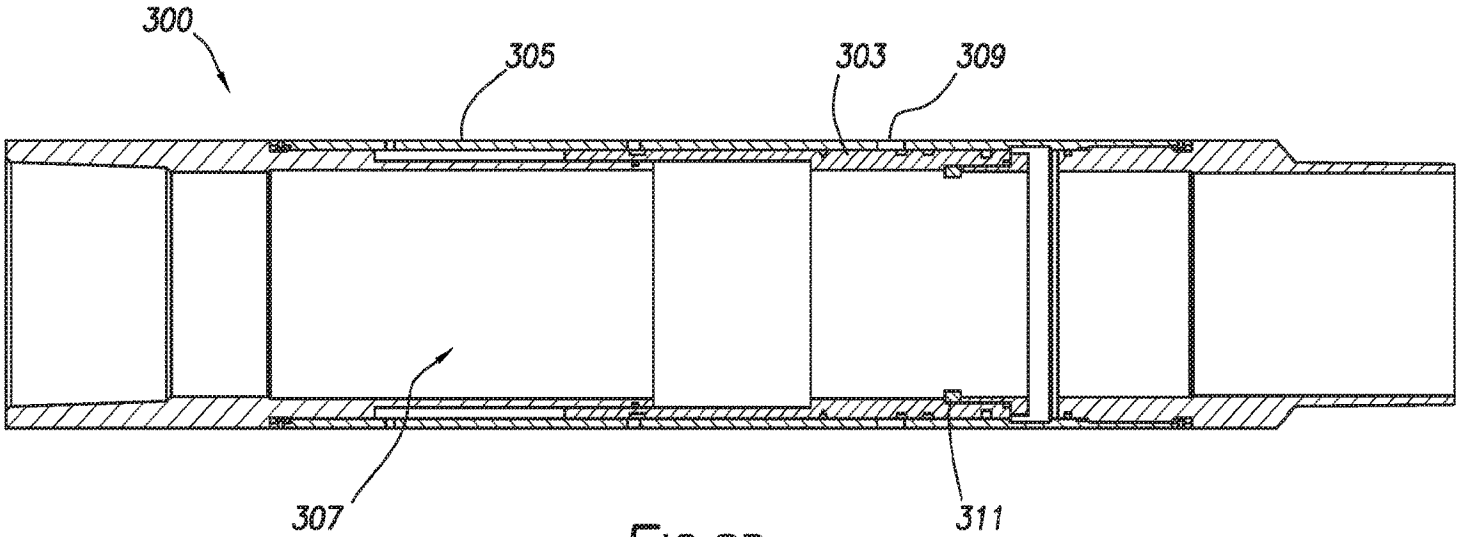
Figure 9:
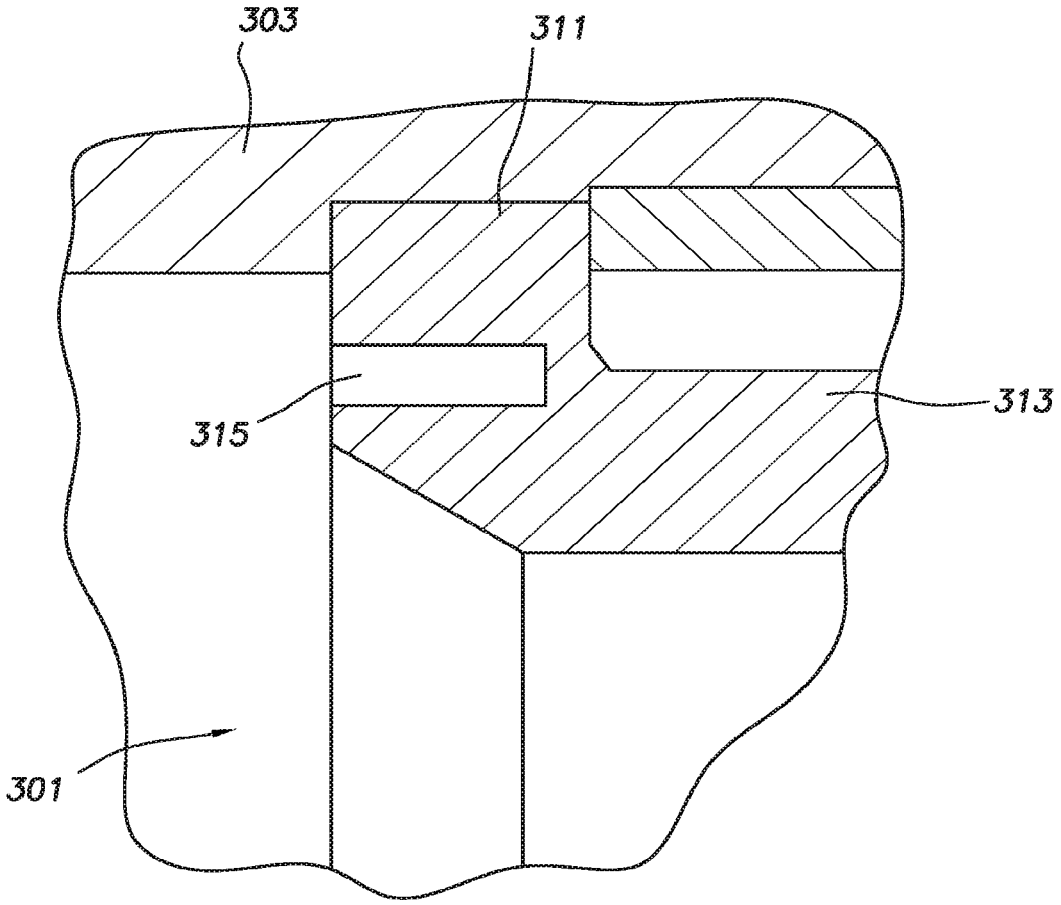
FIG. 9 depicts a detail cross-section view of a fragmentable landing seat consistent with at least one embodiment of the present disclosure.

In some embodiments, fragmentable flange 311 may include annular shear slot 315. As depicted in FIG. 9, annular shear slot 315 may be an annular groove formed in fragmentable landing seat 301. In some embodiments, annular shear slot 315 may be formed such that when a preselected pressure threshold is reached, fragmentable landing seat 301 may shear such that fragmentable flange 311 and seat body 313 separate at annular shear slot 315 as shown in FIG. 8C. The preselected pressure threshold may be determined by, for example and without limitation, the depth of annular shear slot 315, the width of annular shear slot 315, and the material from which fragmentable landing seat 301 is constructed. In such an embodiment, seat body 313 may be moved through and out of hydraulic port collar 300 by continued pressure acting on shifting element 321. Seat body 313 may be moved through at least part of the drill string below hydraulic port collar 300. In such an embodiment, port collar bore 307 of hydraulic port collar 300 may be at full bore diameter as discussed above. In some embodiments, fragmentable landing seat 301 may be formed such that shifting element 321 engages fragmentable landing seat 301 within annular shear slot 315 and does not extend beyond the diameter of annular shear slot 315.

In some embodiments, seat body 313 may be an annular segment adapted to receive shifting element 321. In some embodiments, seat body 313 may be tubular in shape and may extend through hydraulic port collar 300. In some such embodiments, where shifting element 321 is a dart with fins 323 as shown, seat body 313 may be formed of a sufficient length that fins 323 of shifting element 321 are positioned within seat body 313 when shifting element 321 is engaged to fragmentable landing seat 301. In some embodiments, fins 323 may compress radially when inserted into seat body 313. In such an embodiment, when seat body 313 is separated from fragmentable flange 311, shifting element 321 may remain within seat body 313 as it moves through the drill string such that seat body 313 maintains fins 323 in the compressed configuration (as depicted in FIG. 8C), allowing shifting element 321 to pass through the drill string without contacting the inner surface of the drill string.

Figure 10A:
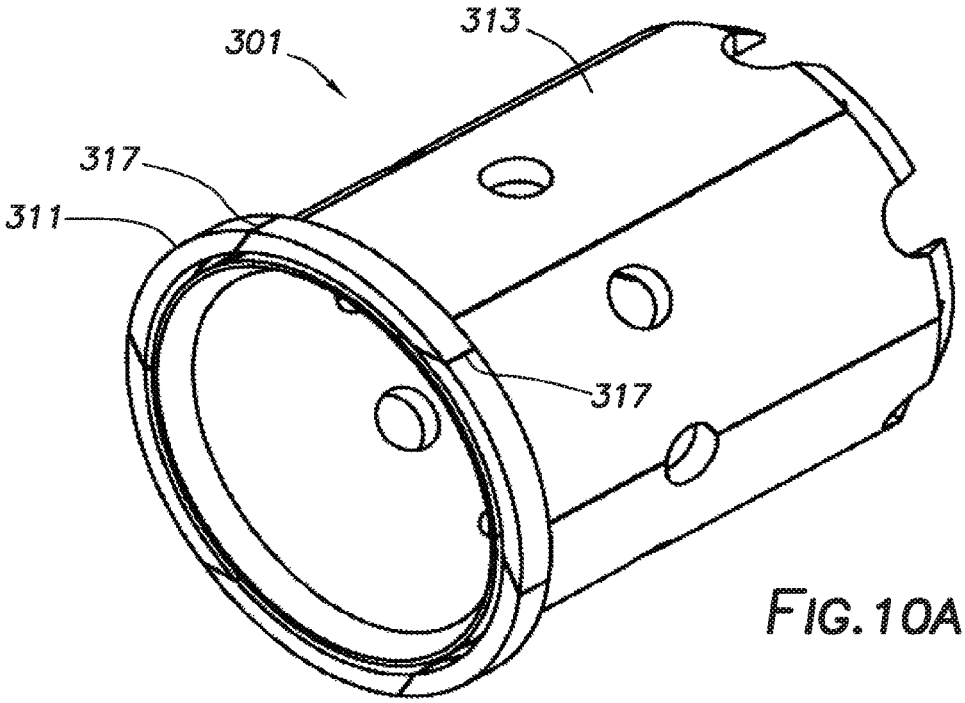
FIGS. 10A-10D depict views of a fragmentable landing seat consistent with at least one embodiment of the present disclosure.
Figure 10B:
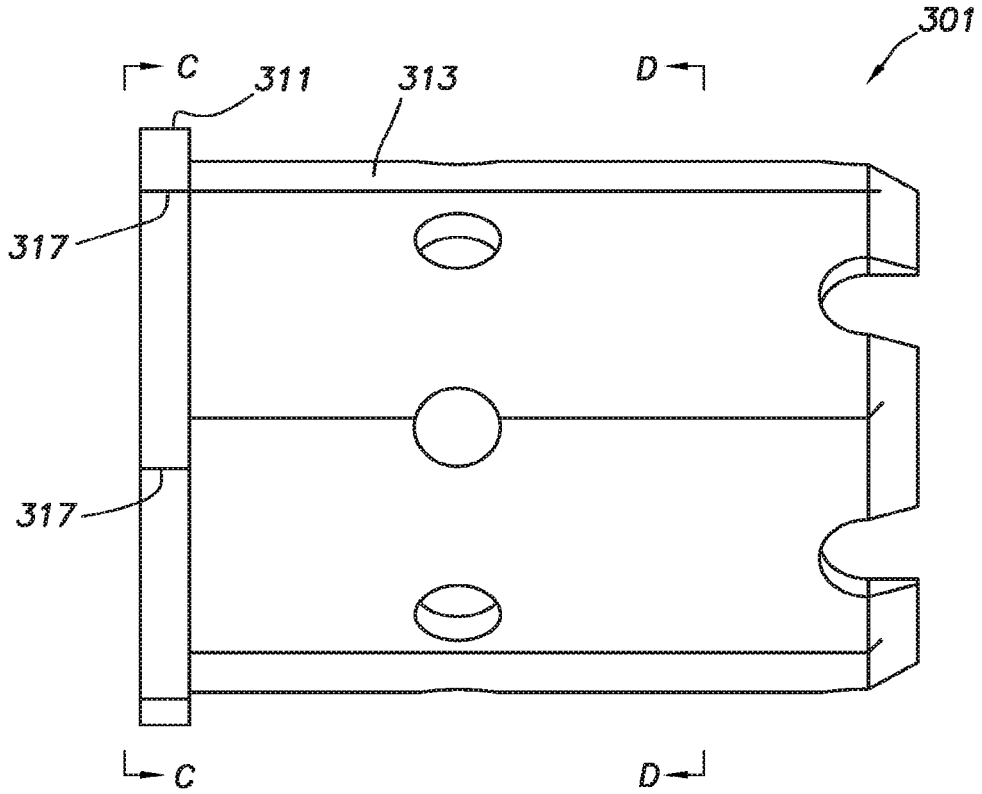
Figure 10D:
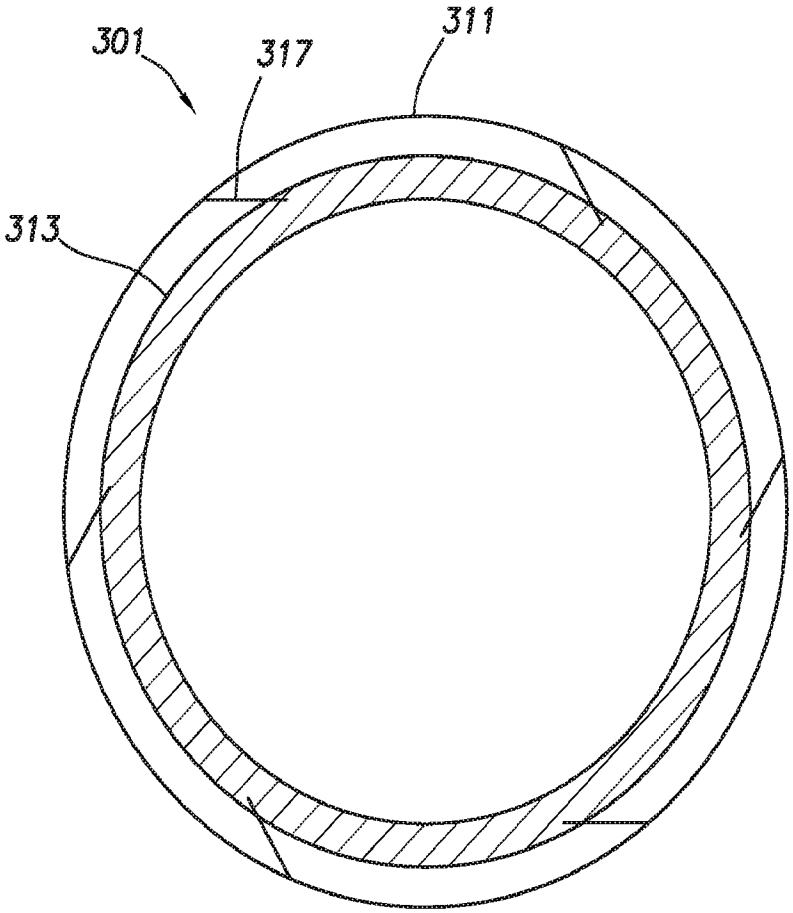
Figure 10C:
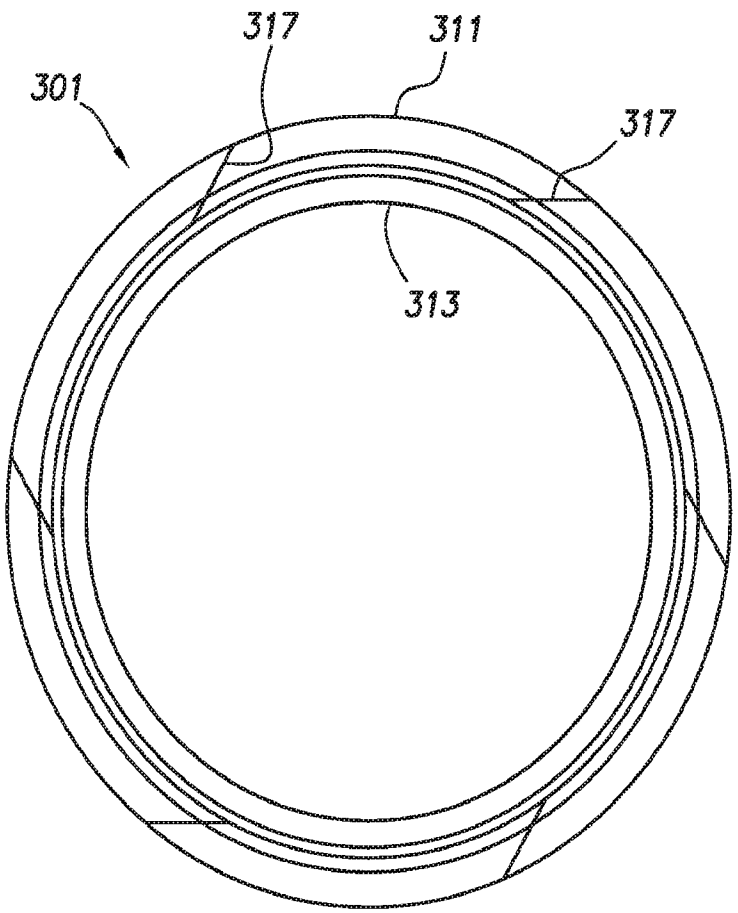
Figure 11:
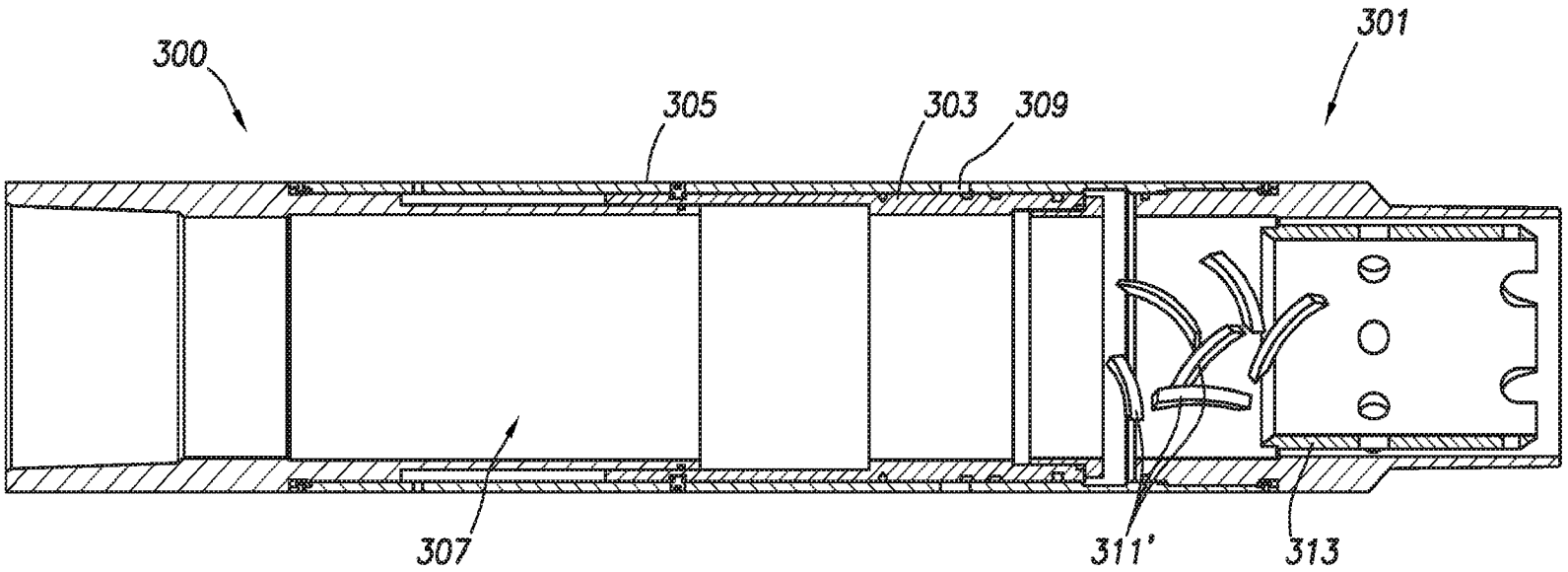
FIG. 11 depicts the port collar of FIGS. 8A-8D with a fragmentable landing seat after fragmentation.

In some embodiments, fragmentable landing seat 301 may include one or more longitudinal shear slots 317 as depicted in FIGS. 10A-C. Longitudinal shear slots 317 may be formed in fragmentable flange 311 alone or in both fragmentable flange 311 and seat body 313. Longitudinal shear slots 317 may be formed to intersect annular shear slot 315. In some embodiments, as depicted in FIG. 11, once annular shear slot 315 shears as discussed above, longitudinal shear slots 317 may allow fragmentable flange 311 to separate into flange fragments 311' that may separate from sliding sleeve 303 and fall into port collar bore 307.

Figure 12:
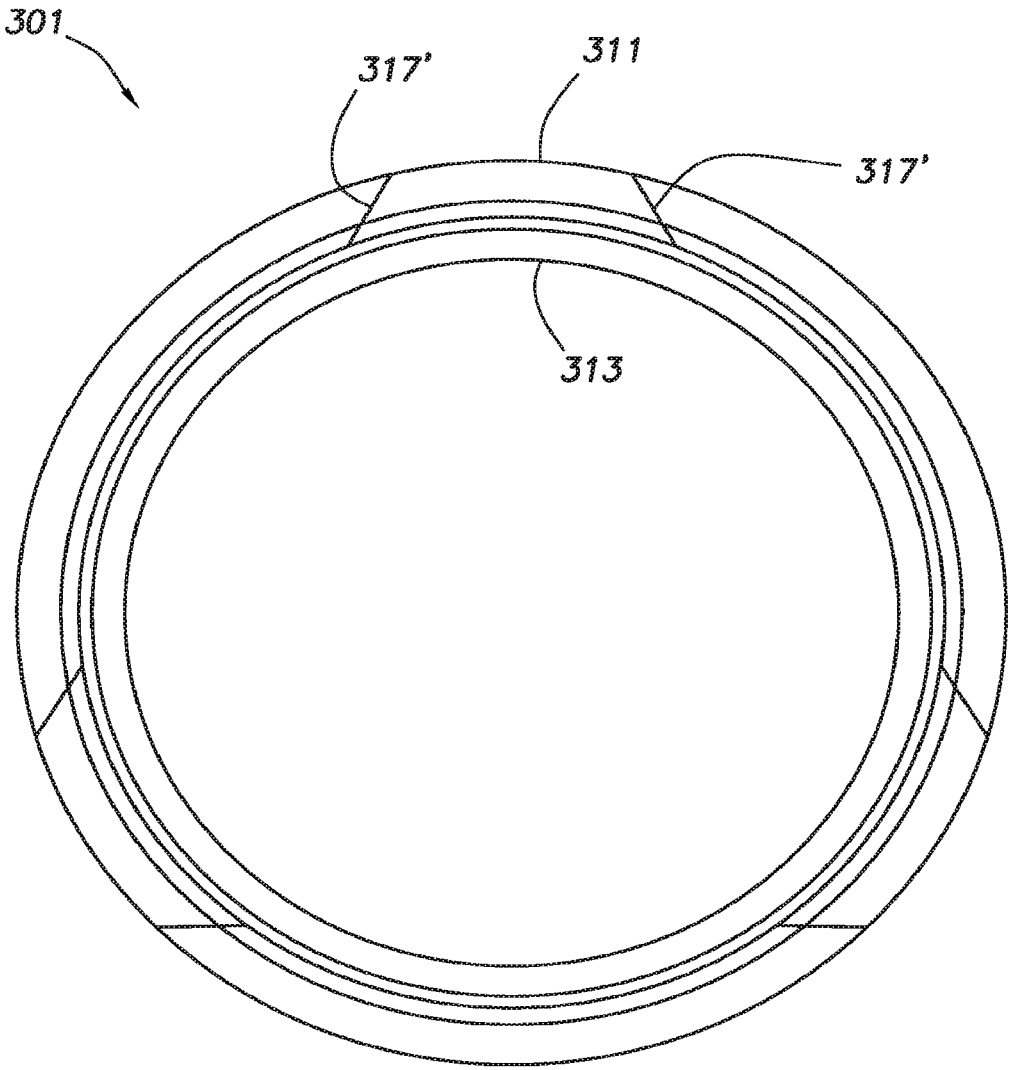
FIG. 12 depicts an end view of a fragmentable landing seat consistent with at least one embodiment of the present disclosure.

In some embodiments, longitudinal shear slots 317 may be formed radially or may be formed at an angle to a radius of fragmentable flange 311. In some embodiments, as depicted in FIG. 10A, longitudinal shear slots 317 may be formed such that each slot is at substantially the same angle to radii of fragmentable flange 311. In some embodiments, as depicted in FIG. 12, longitudinal shear slots 317' may be formed such that longitudinal shear slots 317' alternate between two angles. In some embodiments, such an arrangement may be referred to as axisymmetric slots. In some embodiments, by forming each longitudinal shear slot 317 at an angle to a radius of fragmentable flange 311, flange fragments 311' may be able to enter port collar bore 307 without interfering with adjacent flange fragments 311'. In some embodiments, longitudinal shear slots 317 may be formed at different angles within the scope of this disclosure.

Figure 13B:
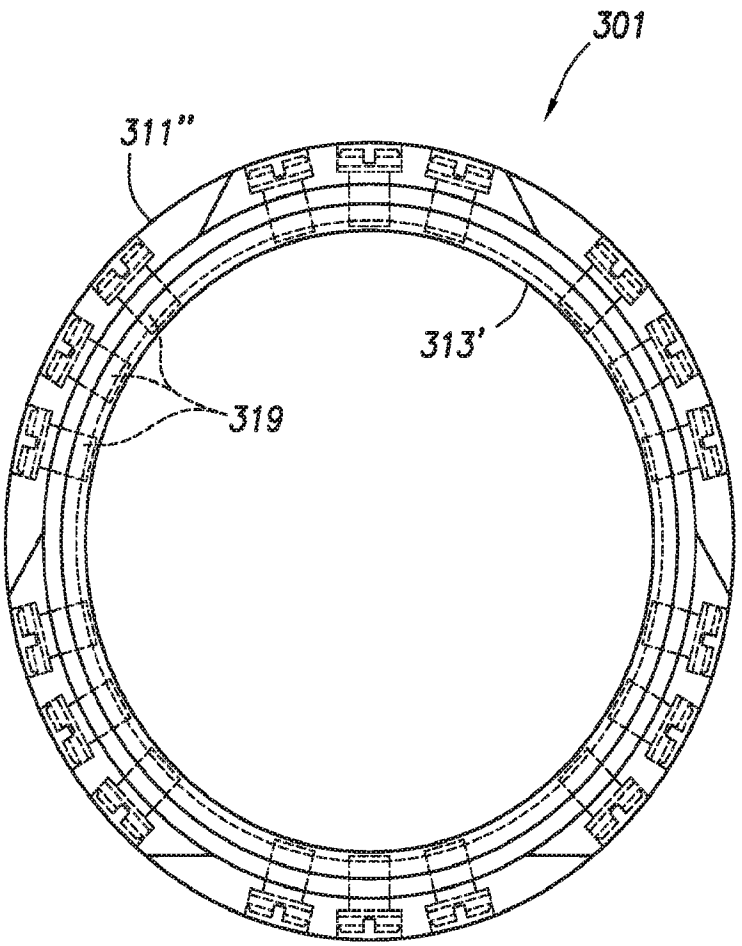
FIGS. 13A, 13B depict views of a fragmentable landing seat consistent with at least one embodiment of the present disclosure.
Figure 13A:
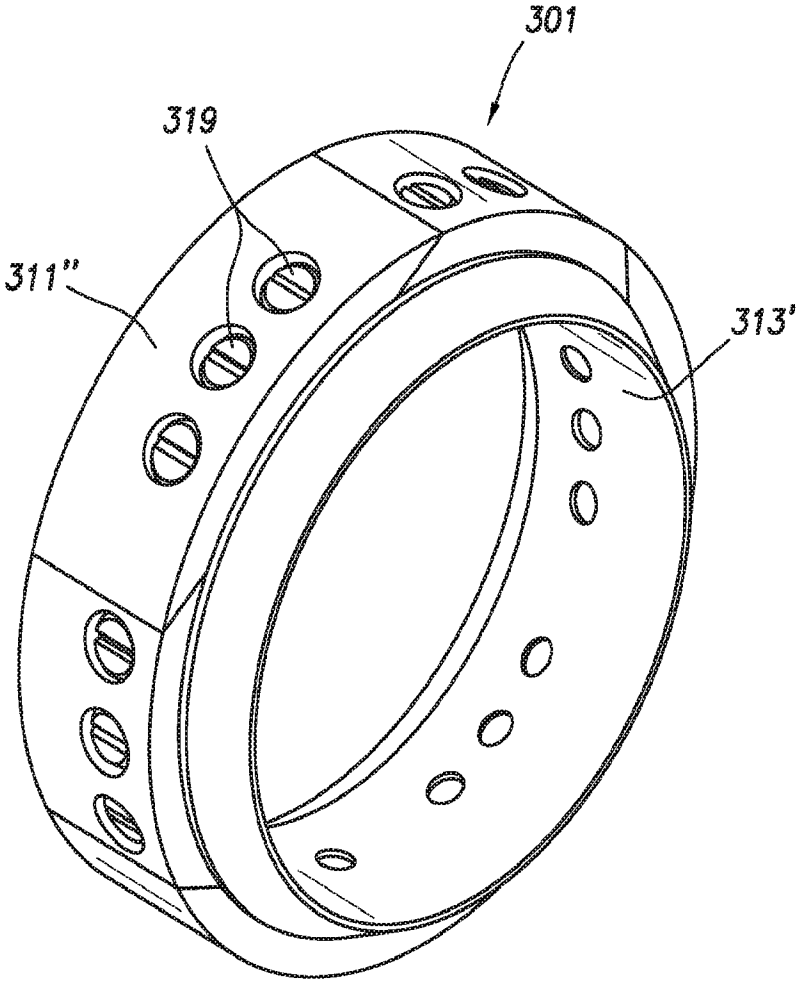

In some embodiments, fragmentable flange 311 and seat body 313 may be formed monolithically by, for example and without limitation, turning or boring. In some embodiments, such as depicted in FIGS. 13A, 13B, fragmentable flange 311" and seat body 313' may be formed separately and mechanically coupled together. In some such embodiments, fragmentable flange 311" may be mechanically coupled to seat body 313' by one or more temporary couplers 319 such as, for example and without limitation, shear bolts, shear pins, shear screws, wires, frangible pin, frangible ring, collet in detent groove, magnetic retainer, adhesive breakable under load, welding or brazing breakable under load, tensile stud breakable under load, or ball detent with spring. In some embodiments, fragmentable flange 311" may be formed from multiple flange fragments positioned about seat body 313' such that fragmentable flange 311" operates as described above with respect to fragmentable flange 311.

Figure 14:
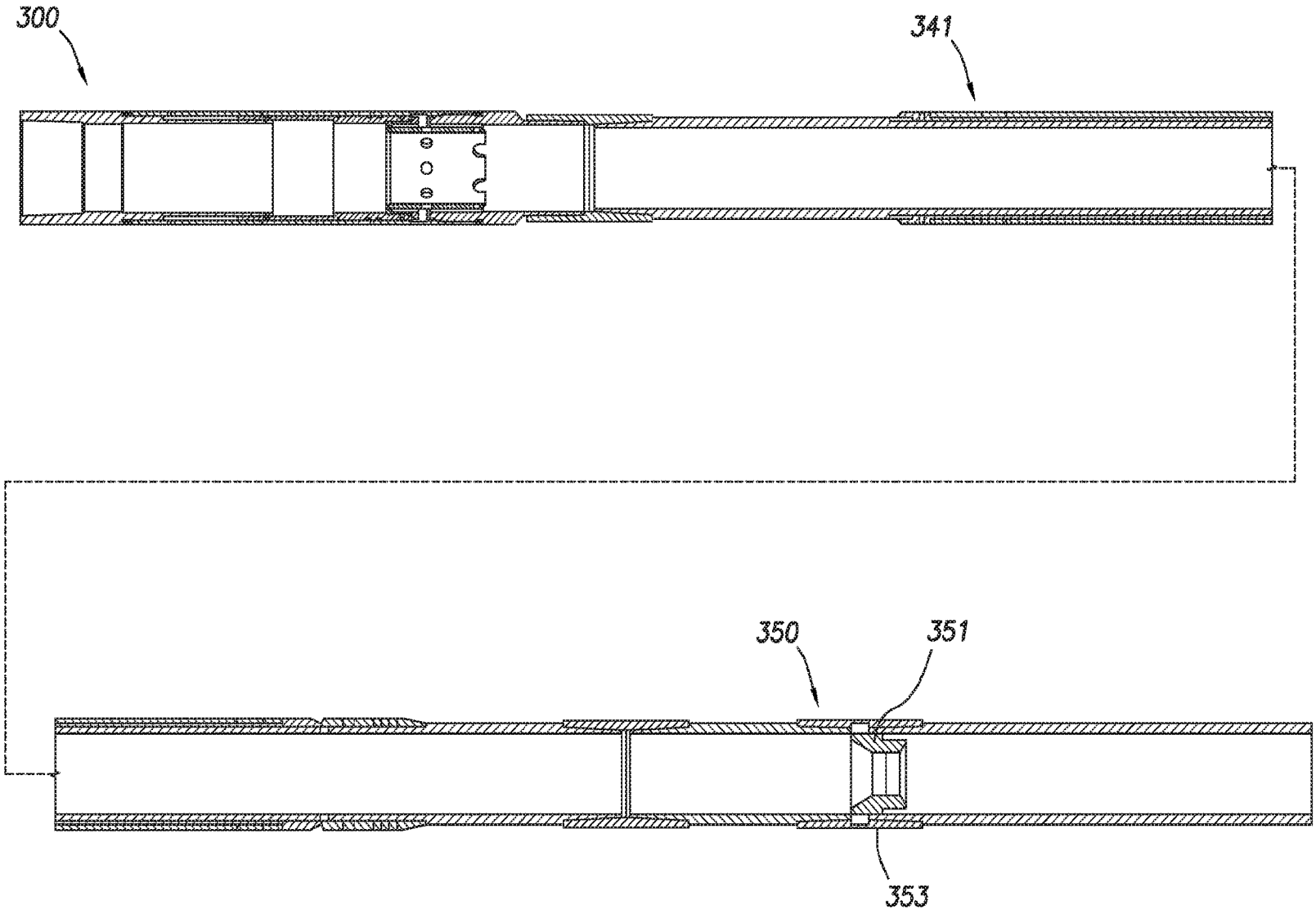
FIG. 14 depicts a downhole tool consistent with at least one embodiment of the present disclosure.

Although described as being used with a port collar, one having ordinary skill in the art with the benefit of this disclosure will understand that fragmentable landing seat 301 may be used with any downhole tool or piece of equipment to catch a ball, dart, plug, or other tool. For example, as depicted in FIG. 14, hydraulic port collar 300 may be mechanically coupled to inflatable packer 341. In some embodiments, landing collar 350 may be positioned below and mechanically coupled to inflatable packer 341. In such an embodiment, landing collar 350 may include fragmentable landing seat 351 positioned to receive a ball, dart, plug, or other tool to selectively isolate the bore of the drill string below landing collar 350 to, for example and without limitation, allow pressure within inflatable packer 341 to be increased. Fragmentable landing seat 351 may be fixedly coupled to outer tubular 353, and may otherwise operate as described with respect to fragmentable landing seat 301 above.

Figure 15A:
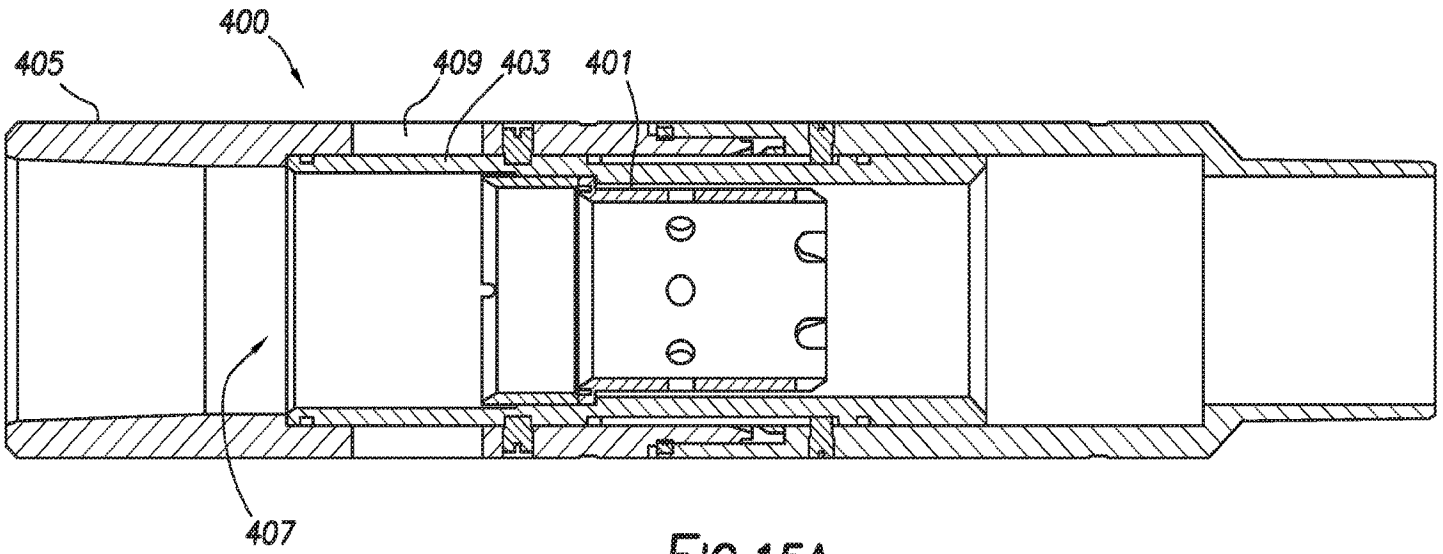
FIGS. 15A, 15B depict a frac sleeve having a fragmentable landing seat consistent with at least one embodiment of the present disclosure.
Figure 15B:
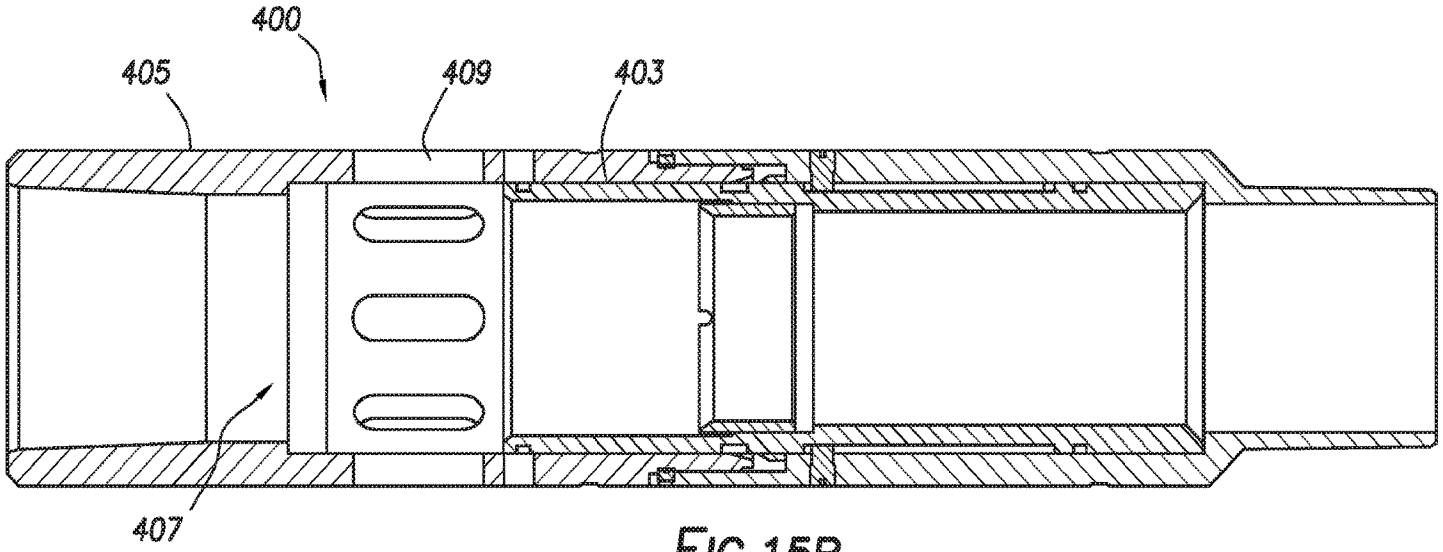

As another example, FIGS. 15A, 15B depict frac sleeve 400 that uses fragmentable landing seat 401. In such an embodiment, fragmentable landing seat 401 may be mechanically coupled to opening sleeve 403 positioned within port housing 405 such that when a ball, dart, plug, or other tool lands on fragmentable landing seat 401 and pressure is increased, opening sleeve 403 is shifted from a closed position (as depicted in FIG. 15A) to an open position (as depicted in FIG. 15B) such that fluid communication between frac collar bore 407 and fracing ports 409 is enabled. Fragmentable landing seat 401 may shear and pass out of frac sleeve 400 as described above, leaving frac collar bore 407 at full bore diameter as discussed above.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without, departing from the spirit and scope of the present disclosure.

The invention claimed is:

1. A hydraulic port collar comprising:

a housing, the housing including one or more housing ports;

a port collar bore disposed within the housing, the port collar bore forming an inner surface of the housing;

a sliding sleeve disposed within the port collar bore, the sliding sleeve having a sliding sleeve inner surface and a sliding sleeve outer surface;

a fragmentable landing seat, the fragmentable landing seat radially aligned with and abutting the sliding sleeve inner surface, the fragmentable landing seat including a fragmentable flange and a seat body, the fragmentable flange mechanically coupled to the sliding sleeve, the fragmentable flange and seat body being selectively decoupleable, the fragmentable landing seat formed as a single member, the fragmentable landing seat comprising an annular shear slot formed in the fragmentable flange such that the fragmentable flange and seat body decouple when a preselected threshold is reached, the fragmentable landing seat including a plurality of longitudinal shear slots formed in the fragmentable flange, the longitudinal shear slots formed to intersect the annular shear slot such that once the annular shear slot shears, the fragmentable flange is separated into a plurality of flange fragments.

2. The hydraulic port collar of claim 1, wherein at least one longitudinal shear slot is formed at an angle to a radius of the fragmentable flange.

3. The hydraulic port collar of claim 2, wherein at least one longitudinal shear slot is formed at an angle to a radius of the fragmentable flange that is different than the angle of a second longitudinal shear slot.

4. The hydraulic port collar of claim 1, wherein the seat body is formed such that a ball, dart, or plug engages the seat body.

5. A hydraulic port collar comprising:

a housing, the housing including one or more housing ports;

a port collar bore disposed within the housing, the port collar bore forming an inner surface of the housing;

a sliding sleeve disposed within the port collar bore, the sliding sleeve having a sliding sleeve inner surface and a sliding sleeve outer surface;

a fragmentable landing seat, the fragmentable landing seat radially aligned with and abutting the sliding sleeve inner surface, the fragmentable landing seat including a fragmentable flange and a seat body, the fragmentable flange mechanically coupled to the sliding sleeve, the fragmentable flange and seat body being selectively decoupleable, the fragmentable flange formed separately from the seat body, wherein the fragmentable flange is mechanically coupled to the seat body by one or more temporary couplers, wherein the temporary couplers comprise one or more of shear bolts, shear pins, shear screws, wires, frangible pin, frangible ring, collet in detent groove, magnetic retainer, adhesive breakable under load, welding or brazing breakable under load, tensile stud breakable under load, or ball detents with spring.

6. A method comprising:

providing a hydraulic port collar, the hydraulic port collar including:

a housing, the housing including one or more housing ports;

a port collar bore disposed within the housing, the port collar bore forming an inner surface of the housing;

a sliding sleeve disposed within the port collar bore, the sliding sleeve having a sliding sleeve inner surface and a sliding sleeve outer surface;

a fragmentable landing seat, the fragmentable landing seat radially aligned with and abutting the sliding sleeve inner surface, the fragmentable landing seat including a fragmentable flange and a seat body, the fragmentable flange mechanically coupled to the sliding sleeve, the fragmentable flange and seat body being selectively decoupleable;

forming an annular shear slot in the fragmentable flange;

forming a plurality of longitudinal shear slots in the fragmentable flange such that the longitudinal shear slots intersect the annular shear slot;

positioning the hydraulic port collar within a wellbore;

increasing the pressure in the port collar bore;

shifting the sliding sleeve upwardly;

engaging a ball, dart, or plug with the fragmentable landing seat increasing the pressure in the port collar bore above a preselected threshold;

decoupling the fragmentable flange from the seat body by separating the fragmentable flange from the seat body at the annular shear slot;

separating the fragmentable flange into a plurality of flange fragments; and allowing the flange fragments to fall into the port collar bore.

7. A method comprising:

providing a hydraulic port collar, the hydraulic port collar including:

a housing, the housing including one or more housing ports;

a port collar bore disposed within the housing, the port collar bore forming an inner surface of the housing;

a sliding sleeve disposed within the port collar bore, the sliding sleeve having a sliding sleeve inner surface and a sliding sleeve outer surface;

a fragmentable landing seat, the fragmentable landing seat radially aligned with and abutting the sliding sleeve inner surface, the fragmentable landing seat including a fragmentable flange and a seat body, the fragmentable flange mechanically coupled to the sliding sleeve, the fragmentable flange and seat body being selectively decoupleable, wherein the seat body and fragmentable flange are formed separately;

providing the seat body and fragmentable flange;

mechanically coupling the fragmentable flange to the seat body by one or more temporary couplers, wherein the temporary couplers comprise one or more of shear bolts, shear pins, shear screws, wires, frangible pin, frangible ring, collet in detent groove, magnetic retainer, adhesive breakable under load, welding or brazing breakable under load, tensile stud breakable under load, or ball detents with spring;

positioning the hydraulic port collar within a wellbore;

increasing the pressure in the port collar bore;

shifting the sliding sleeve upwardly;

engaging a ball, dart, or plug with the fragmentable landing seat;

increasing the pressure in the port collar bore above a preselected threshold; and decoupling the fragmentable flange from the seat body.

* * * * *